US006681536B1

(12) United States Patent
Isoda

(10) Patent No.: US 6,681,536 B1
(45) Date of Patent: Jan. 27, 2004

(54) MOUNTING STRUCTURE AND METHOD FOR VISCOSITY SYSTEM DAMPING WALL

(75) Inventor: Kazuhiko Isoda, Tokyo (JP)

(73) Assignee: Shimizu Corporation, Tokyo (JP)

( * ) Notice: Subject to any disclaimer, the term of this patent is extended or adjusted under 35 U.S.C. 154(b) by 0 days.

(21) Appl. No.: 09/806,909

(22) PCT Filed: Sep. 1, 1999

(86) PCT No.: PCT/JP99/04737

§ 371 (c)(1),
(2), (4) Date: Jun. 26, 2001

(87) PCT Pub. No.: WO01/16445

PCT Pub. Date: Mar. 8, 2001

(65) Prior Publication Data

(65)

(51) Int. Cl.[7] ..... E04B 1/98
(52) U.S. Cl. ..... 52/167.8; 52/745.1; 52/745.09
(58) Field of Search ..... 52/167.1, 167.2, 52/167.4, 167.8, 745.1, 745.09

(56) References Cited

U.S. PATENT DOCUMENTS

| | | | | | |
|---|---|---|---|---|---|
| 5,349,794 | A | * | 9/1994 | Taga | 52/167 CB |
| 5,740,652 | A | * | 4/1998 | Katase et al. | 52/745.1 |
| 6,037,403 | A | * | 3/2000 | Katase et al. | 524/579 |
| 6,457,284 | B1 | * | 10/2002 | Isoda | 52/167.1 |
| 6,601,350 | B1 | * | 8/2003 | Isoda | 52/167.1 |

FOREIGN PATENT DOCUMENTS

| | | | |
|---|---|---|---|
| EP | 1111162 | * | 6/2001 |
| EP | 1111163 | * | 6/2001 |
| EP | 1126101 | * | 8/2001 |
| JP | 59-52069 | | 3/1984 |
| JP | 8-338153 | | 12/1996 |
| JP | 9-157450 | * | 6/1997 |
| JP | 9-310531 | | 12/1997 |
| JP | 10-46865 | | 2/1998 |
| JP | 10-220063 | | 8/1998 |
| JP | 11-217955 | * | 8/1999 |
| JP | 2000-27484 | * | 1/2000 |
| JP | 2001-49894 | * | 2/2001 |

* cited by examiner

*Primary Examiner*—Carl D. Friedman
*Assistant Examiner*—Yvonne M. Horton
(74) *Attorney, Agent, or Firm*—Nixon & Vanderhye

(57) ABSTRACT

In a structure for installing a viscous vibration-damping wall 1, the viscous vibration-damping wall 1 is constructed such that a housing 16 with its upper end open is formed by uprightly setting a pair of steel-made side plates 15 on a base plate 8 and by disposing a pair of flange plates 11 on both sides of the pair of side plates, an intermediate plate 13 is inserted in the housing 16, and a viscous material or a viscoelastic material is placed in its gap portion. In order to install the viscous vibration-damping wall 1, a flange of a lower-floor girder 3 is provided with base-plate connecting portions and a pair of flange connecting plates 7, and the base plate 8 and the flange plates 11 are connected thereto, and the intermediate plate 13 is directly connected to a gusset plate 12 fixed to a flange of an upper-floor girder 4. Consequently, the dispersion of the stress is rationalized, and the reduction of constituent members is attained.

8 Claims, 7 Drawing Sheets

MOUNTING STRUCTURE AND METHOD FOR VISCOSITY SYSTEM DAMPING WALL

TECHNICAL FIELD

The present invention relates to a structure for installing a viscous vibration-damping wall and a method of installing the same, and more particularly to a structure for installing a viscous vibration-damping wall whose connecting structure is simple and which, while possessing a sufficient withstanding force, can be manufactured at low cost by making improvements on the structure for installing the viscous vibration-damping wall on a main frame structure, as well as a method of installing the same.

BACKGROUND ART

Measures for enhancing the damping performance of structures have been adopted since ancient times to enhance the safety of earthquake resistance of building structures and improve the dwelling ability of structures against the wind and other dynamic external forces. As specific solutions therefor, viscous vibration-damping walls have been put to practical use, and the number of the viscous vibration-damping walls actually adopted has been on an increasing trend in recent years.

The viscous vibration-damping wall is constructed such that an upper-end open housing, which is formed by a pair of steel-made side plates mounted on a base plate and a pair of flange plates disposed on both sides of the pair of side plates, is integrated with a lower-floor girder, an intermediate plate integrated with an upper-floor girder is inserted in it, and a viscous material or a viscoelastic material is placed in the gap therebetween with a predetermined thickness.

To build the vibration-damping wall, connection to a main frame structure is required, but under the present circumstances connection metal plates from the main frame structure for connection to the viscous vibration-damping wall include a large number rib plates and make the joints complex, constituting a factor for higher cost.

Referring to FIG. 7, a description will be given of the connection between a conventional viscous vibration-damping wall and the main frame structure. A base plate 32 of a housing 31 making up a vibration-damping wall 30 is bolted to a flange surface of a rising metal plate 34 disposed on a lower-floor girder 33, while an intermediate plate 35 of the vibration-damping wall has a top plate 36 welded to its tip portion and is bolted to a flange surface of a mounting plate 38 disposed on an upper-floor girder 37.

In this state, when the vibration-damping wall 30 bears a horizontal force due to an external force, bending moment due to the borne shearing force occurs in the top plate 36 and the base plate 32 at the upper and lower ends.

The stress applied to the joints acts as the horizontal shearing force with respect to the bolts at the plane of connection, and at the same time a vertical axial force which is distributed widely at the edge portions of the vibration-damping wall 30 occurs in the bolts at the plane of connection due to the bending moment. As a result, large bending stresses occur in the top plate 36 and the base plate 32 having bolt hole portions arranged horizontally, so that it is necessary to adopt countermeasures for the respective plates.

Consequently, as shown in the drawing, a multiplicity of vertical rib plates 39 and 40 are fixed to the base plate 32 and the top plate 36 as well as the rising metal plate 34 and the mounting plate 38 corresponding thereto, and large-scale reinforcement is provided particularly at the edge portions of the vibration-damping wall. This results in an enormously large increase in cost, and constitutes a hindrance to the connection to a member perpendicular to a girder, and to through holes of sleeves of the facility.

Since the damping performance which can be added to a structure is proportional to the quantity of vibration-damping walls that are installed, it is desirable to adopt a large number of vibration-damping walls. However, since the cost required in the installation is also proportional to the quantity used, it is an important problem to reduce the cost of the building construction of the vibration-damping walls and to prevent adverse effects from being exerted on other execution of works.

To overcome this problem, a method of building construction has been proposed in which all the upper and lower flange portions are removed. (Refer to JP-A-10-46865)

In this proposal, as shown in the drawing, a bolting steel plate 52 is provided which has the same thickness as an inner wall steel plate 51 of a vibration-damping wall 50 to be fixed to the underside of an upper-floor girder or a reinforced portion thereof, and the inner wall steel plate 51 of the vibration-damping wall is disposed immediately therebelow. A pair of bolting reinforcing plates 53 are disposed on both sides of the inner wall steel plate 51, and the three steel plates are tightened by high-strength bolts 54 so as to be integrated.

In addition, on a lower floor side, a bolting lower steel plate 56 is welded in advance to lower sides of a pair of outer wall steel plates 55 of the vibration-damping wall, and a steel plate 57 of the same thickness as the bolting lower steel plate 56 is provided on a lower-floor girder, and is integrated therewith in the same way as the upper side.

An assertion is made that it is possible to substantially reduce the cost required for the overall building construction of the vibration-damping wall, since the mechanism for transmitting the stress can be rationalized and the fabrication of the vibration-damping wall itself and the fixing portions can be both simplified by virtue of the construction in which flanged connection in each of the upper and lower portions is eliminated, as described above.

However, with the vibration-damping wall according to this proposal, the vibration-damping wall itself is specially provided with the bolting lower steel plate, the inner wall steel plate is provided with an upper reinforced portion, and the friction-type high-strength bolted connection for jointing adopts a structure in which a multiplicity of bolts are arranged on end portion sides of the vibration-damping wall. Such a construction is a natural consequence of the fact that the bolting lower steel plate and the inner wall steel plate need to simultaneously withstand both the shearing force and the tensile force with respect to the bending moment occurring in the vibration-damping wall. A substantial thickness must be inevitably secured for the bolting lower steel plate, so that the cost of the vibration-damping wall itself is not much different from other conventional vibration-damping walls.

In addition, concerning the handling of the vibration-damping wall, since the structure adopted is such that the vibration-damping wall cannot be self-supported, special attention is required for safety and workability under the circumstances of transportation, storage, and on-site setting.

The present invention provides a structure for installing a viscous vibration-damping wall which is simple while possessing a sufficient withstanding force, and which can be manufactured at low cost by making improvements on the structure for connection at the time of installing the viscous vibration-damping wall on a main frame structure, as well as a method of installing the same.

DISCLOSURE OF INVENTION

The structure for installing a viscous vibration-damping wall in accordance with the present invention is basically a structure for installing a viscous vibration-damping wall in which a housing with its upper end open is formed by uprightly setting a pair of steel-made side plates on a base plate and by disposing a pair of flange plates on both sides of the pair of side plates, an intermediate plate is inserted in the housing, and a viscous material or a viscoelastic material is placed in its gap portion, characterized in that a flange of a lower-floor girder is provided with base-plate connecting hole portions and a pair of flange connecting plates, and the base plate and the flange plates are connected thereto, and the intermediate plate is directly connected to a gusset plate fixed to a flange of an upper-floor girder. Specifically, the structure for installing a viscous vibration-damping wall is characterized in that a rising metal plate is fixed on the flange of the lower-floor girder, and the base-plate connecting hole portions and the pair of flange connecting plates are provided on the rising metal plate, that the connection between the flange plate and the flange connecting plate is one-plane friction-type high-strength bolted connection, and that the direct connection between the intermediate plate and the gusset plate is one-plane friction-type high-strength bolted connection or two-plane friction-type high-strength bolted connection using a pair of splicing plates.

By virtue of the above-described structure, the top plate, the brackets, and the reinforcing rib plates at various portions which have been used in the building construction of the vibration-damping wall are made substantially unnecessary, the reduction of the thickness of the base plate and the number of bolts is attained, and the vibration-damping wall can be self-supported, so that the safety of construction work and workability are improved.

In addition, the method of installing a viscous vibration-damping wall in accordance with the present invention comprises the steps of: setting the lower-floor girder comprising the base-plate connecting hole portions and the flange connecting plates; setting at a predetermined position the upper-floor girder with which the viscous vibration-damping wall is integrated by connecting the intermediate plate to the gusset plate provided on the upper-floor girder and by connecting the housing to the upper-floor girder by means of a pair of temporarily connecting members for temporarily connecting the housing to the upper-floor girder; subjecting the base plate and the flange plates to friction-type high-strength bolted connection to the base-plate connecting hole portions and the flange connecting plates, respectively, of the lower-floor girder; and removing the temporarily connecting members from the housing and the upper-floor girder. Accordingly, handling is simple, sheer deformation of the viscous material can be prevented, and the movability of the vibration-damping wall is prevented.

The structure for installing a viscous vibration-damping wall in accordance with the present invention is characterized in that, in order to install a viscous vibration-damping wall constructed such that a housing with its upper end open is formed by uprightly setting a pair of steel-made side plates on a base plate and by disposing a pair of flange plates on both sides of the pair of side plates, an intermediate plate is inserted in the housing, and a viscous material or viscoelastic material is placed in its gap portion, a flange of a lower-floor girder is provided with base-plate connecting hole portions and a pair of flange connecting plates, and the base plate and the flange plates are connected thereto, and the intermediate plate is directly connected to a gusset plate fixed to a flange of an upper-floor girder. Accordingly, advantages are offered in that the top plate, the brackets, and the reinforcing rib plates at various portions which have been used in the building construction of the vibration-damping wall are made unnecessary, and the reduction of the thickness of the base plate and the number of bolts is attained, thereby making it possible to reduce the cost. Further, since the vibration-damping wall can be self-supported, an advantage can be demonstrated in that the safety of construction work and workability can be improved.

In addition, the method of installing a viscous vibration-damping wall in accordance with the present invention is characterized by comprising the steps of: setting the lower-floor girder; setting at a predetermined position the upper-floor girder to the gusset plate of which the intermediate plate is connected and with which the housing is integrated by means of a pair of temporarily connecting members; subjecting the base plate and the flange plates to friction-type high-strength bolted connection to the base-plate connecting hole portions and the flange connecting plates, respectively, of the lower-floor girder; and removing the temporarily connecting members from the housing and the upper-floor girder. Accordingly, advantages are offered in that handling can be made simple, shear deformation of the viscous material can be prevented, and the movability of the vibration-damping wall can be prevented.

Hereafter, a description will be given of the embodiments of the present invention with reference to the drawings.

EMBODIMENTS

Figure 1:
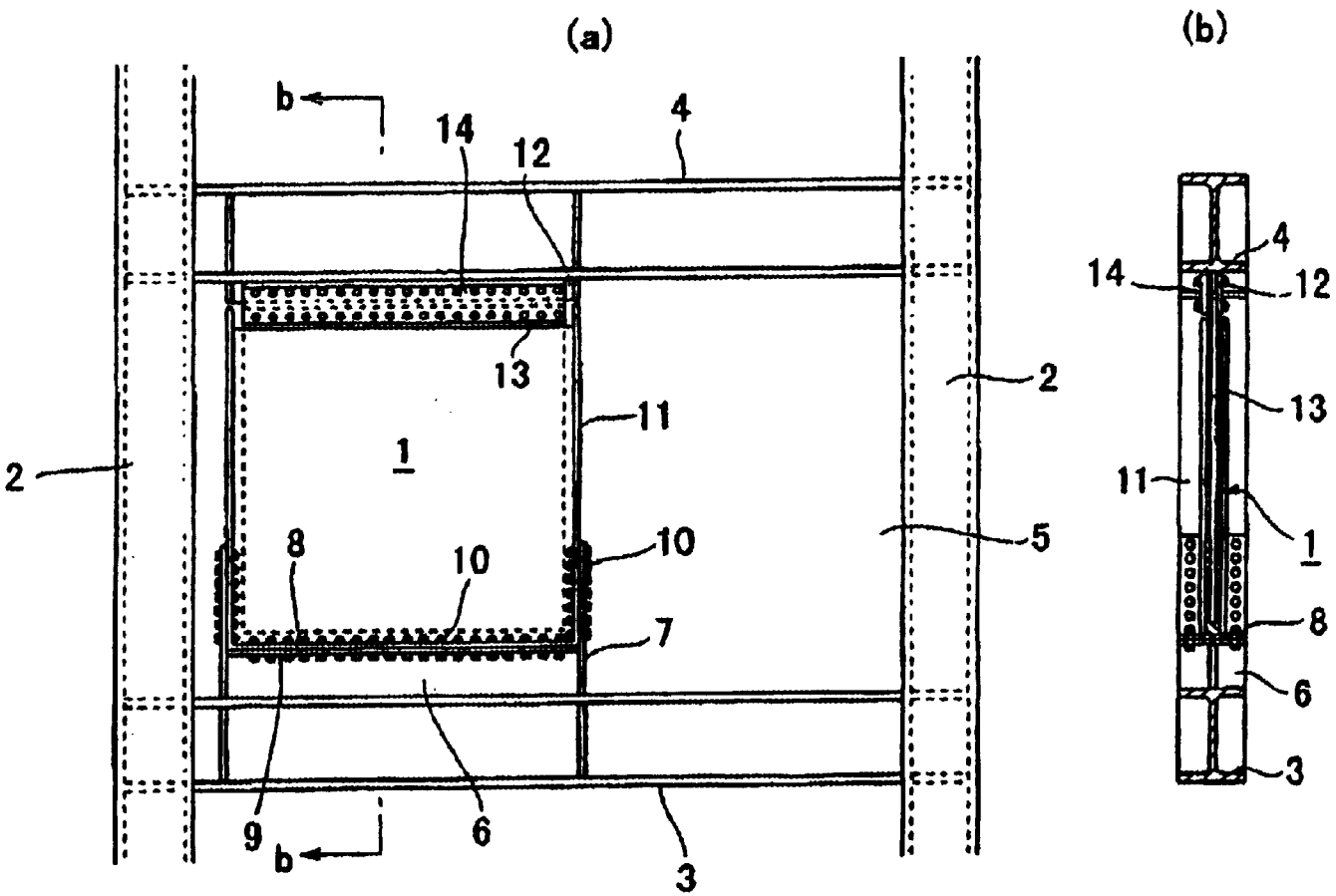
FIG. 1 is a diagram of a state in which a viscous vibration-damping wall in accordance with the invention is installed on a main frame structure.

FIG. 1 is an elevational view and a cross-sectional view, taken in the direction of arrows, of a state in which a viscous vibration-damping wall in accordance with the invention is installed on a main frame structure.

A viscous vibration-damping wall 1 is disposed in a plane of structure 5 which is formed by a pair of pillars 2, a lower-floor girder 3, and an upper-floor girder 4, and is joined to the lower-floor girder 3 and the upper-floor girder 4, respectively.

Although the viscous vibration-damping wall 1 may be mounted directly on the lower-floor girder 3 having base-plate connecting hole portions and a pair of flange connecting plates, in this embodiment a description will be given of a viscous vibration-damping wall which is provided with a rising metal plate for reasons which will be described later.

A pair of flange connecting plates 7 are welded to a rising metal plate 6 welded to a flange surface of the lower-floor girder 3, and is thus integrated with the lower-floor girder 3. The rising metal plate 6 is adopted to set the working plane for the friction-type high-strength bolted connection of the viscous vibration-damping wall 1 on a floor slab without damaging the base metal of the lower-floor girder 3 by bolt holes and the like. The adoption of the rising metal plate 6 has an advantage in that when the need has arisen to replace the viscous vibration-damping wall 1, the replacement work is facilitated.

The interval between the pair of flange connecting plates 7 is set to be slightly larger than the external width of the viscous vibration-damping wall 1, and an arrangement is provided such that the gap can be adjusted at the time of installation at the site.

The viscous vibration-damping wall 1 is placed on the rising metal plate 6, and a base plate 8 of the viscous vibration-damping wall and base-plate connecting hole portions 9 of the rising metal plate 6 are frictionally connected in one plane by high-strength bolts 10. Similarly, a flange plate 11 on each side of the viscous vibration-damping wall and the flange connecting plate 7 are frictionally connected in one plane by the high-strength bolts 10, thereby integrally joining the viscous vibration-damping wall 1 and the lower-floor girder 3.

The flange connecting plates 7 process as the shearing force of the high-strength bolts the bending moment occurring due to the shearing force which is borne by the viscous vibration-damping wall 1 during an earthquake, by making use of the fact that the bending moment is converted to vertical force at the portions of the flange plates 11 disposed on both sides of the viscous vibration-damping wall, thereby suppressing and damping the lifting force of the base plate and the vertical force occurring substantially in edge portions of the viscous vibration-damping wall.

Accordingly, the base plate 8 of the viscous vibration-damping wall 1 and the base-plate connecting hole portions 9 of the rising metal plate 6 are of the base plate type in the same way as the conventional art. However, since a tensile force does not occur in the connection bolts unlike the conventional viscous vibration-damping wall, reinforcing rib plates are not required, and a simple state of connection with small thickness is thus formed.

A gusset plate 12 is attached by welding to a lower flange surface of the upper-floor girder 4 in alignment with the web of the girder.

An intermediate plate 13 of the viscous vibration-damping wall 1 together with the gusset plate 12 is clamped by two splicing plates 14 in order to be directly connected to the gusset plate 12, and the intermediate plate 13 and the gusset plate 12 are directly connected to each other by being frictionally connected in two planes by the high-strength bolts 10. The viscous vibration-damping wall 1 and the upper-floor girder 4 are thus integrally joined by these members.

In the direct connection between the intermediate plate 13 and the gusset plate 12, since a top plate provided on a conventional intermediate plate and a bracket suspended from the upper-floor girder are eliminated, the height of the viscous vibration-damping wall can be made large, and the shear area of the viscous vibration-damping material is increased, thereby making it possible to improve the damping performance.

It should be noted that a pair of flange plates having screw holes for temporarily attaching a pair of temporarily connecting members, which will be described later, are respectively provided at both ends of the gusset plate 12 in a direction perpendicular to the web of the upper-floor girder.

Figure 2:
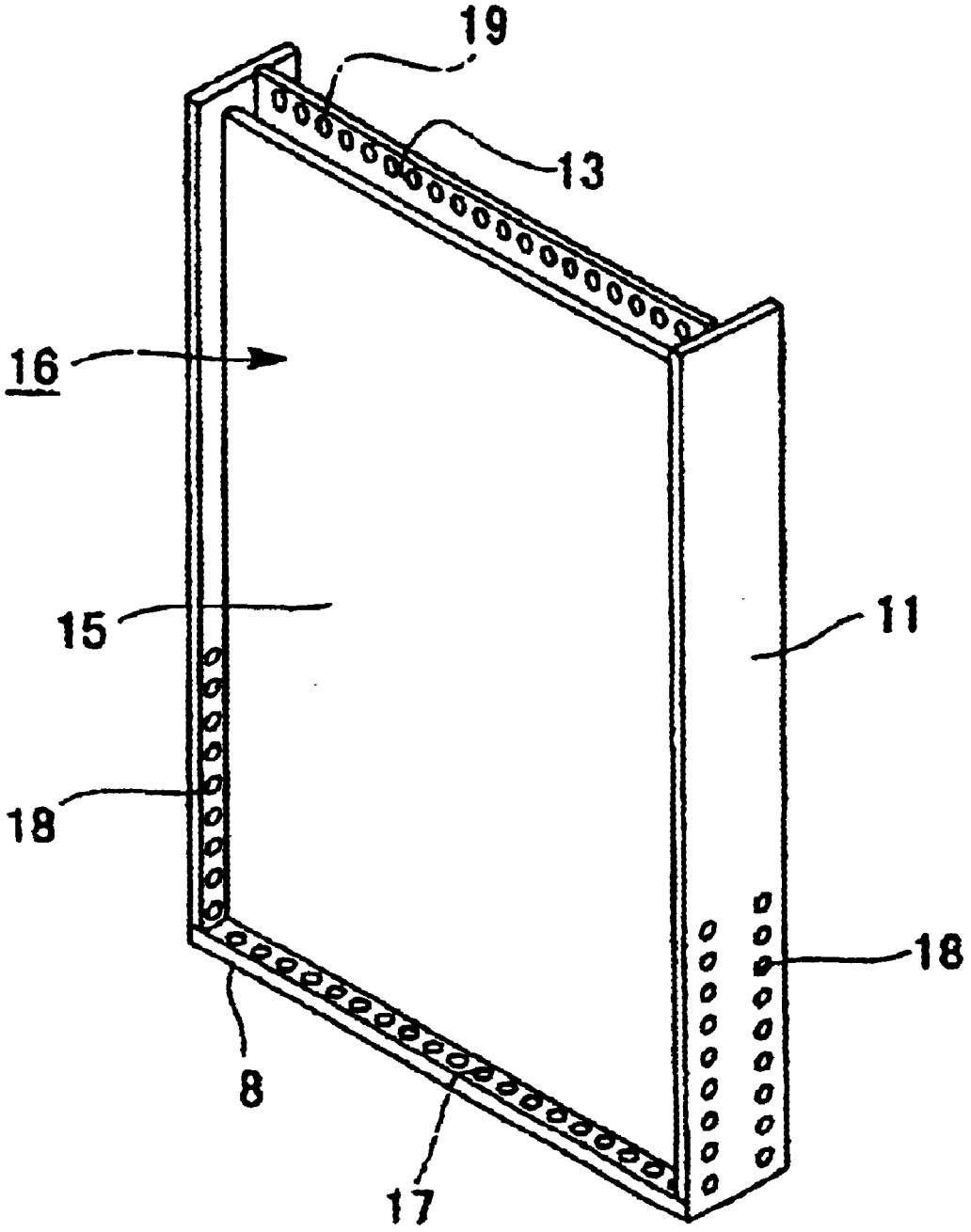
FIG. 2 is a perspective view of the viscous vibration-damping wall in accordance with the invention.

FIG. 2 is a perspective view of the viscous vibration-damping wall.

In the viscous vibration-damping wall 1, as shown in the drawing, a housing 16 with its upper end open is formed by uprightly setting a pair of steel-made side plates 15 on the base plate 8 and by disposing the pair of flange plates 11 on both sides of the pair of side plates 15, and the intermediate plate 13 is inserted in the housing 16. A viscous material or a viscoelastic material is placed in the gap between the housing 16 and each side of the intermediate plate 13, and the arrangement provided is such that a horizontal force applied from the outside is dampened between the base plate 8 and the intermediate plate 13.

The base plate method enhances the safety of construction work and facilitates site work since the viscous vibration-damping walls can be self-supported stably during their transportation, storage, and on-site setting.

Although the base plate 8 in its outward appearance appears to be the same as the conventional viscous vibration-damping wall, since it is unnecessary to withstand the vertical force, as described above, it is unnecessary to provide the reinforcing rib plates, so that a simple shape with small thickness can be obtained.

The base plate 8 and the flange plates 11 are respectively provided with bolt holes 17 and 18 for the high-strength bolts for effecting one-plane friction-type connection to the base-plate connecting hole portions and the flange connecting plates which are respectively provided on the rising metal plate. Provided in a tip portion of the intermediate plate 13 are bolt holes 19 for the high-strength bolts for effecting two-plane friction-type connection to the splicing plates 14 at the time of directly connecting the intermediate plate 13 to the gusset plate 12.

Figure 3:
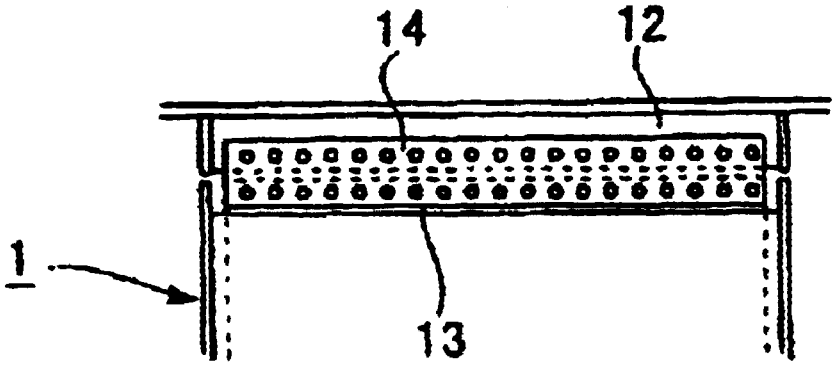
FIG. 3 is a diagram of a state in which the viscous vibration-damping wall is fixed to an upper-floor girder.

FIG. 3 shows an embodiment of connecting the intermediate plate and the gusset plate.

In this embodiment, the gusset plate 12 and the intermediate plate 13 are directly connected. Namely, the gusset plate 12 and the intermediate plate 13 are clamped by the two splicing plates 14, and are connected by being subjected to two-plane friction-type connection by the high-strength bolts 10 arranged in parallel in the splicing plates 14. The viscous vibration-damping wall 1 and the upper-floor girder 4 are thereby integrally connected.

In the direct connection of the gusset plate 12 and the intermediate plate 13, the splicing plates are not necessarily required, and if the welding position of the gusset plate is offset in advance from the center of the web of the upper-floor girder such that the center of the web of the upper-floor girder and the center of the intermediate plate are aligned with each other, the direct connection of the gusset plate 12 and the intermediate plate 13 can be also effected by directly connecting them by one-plane friction-type connection using the high-strength bolts.

The adoption of this one-plane friction-type connection contributes to the reduction of the cost since the splicing plates are disused.

Figure 4:
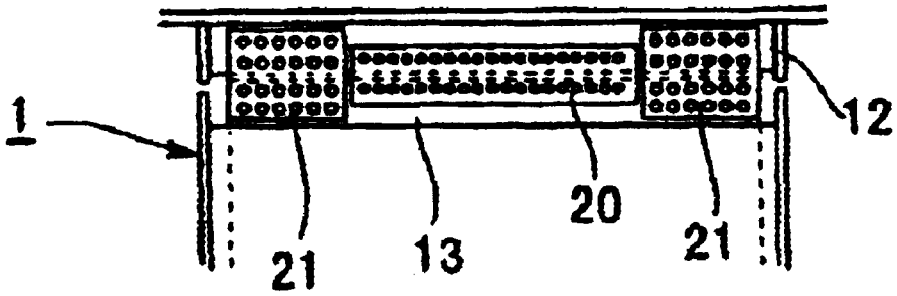
FIG. 4 is a diagram of another state in which the viscous vibration-damping wall is fixed to the upper-floor girder.

FIG. 4 shows another embodiment of connecting the intermediate plate and the gusset plate.

In this embodiment, although there is no specific change in the intermediate plate, a difference lies in that each splicing plate is divided into a central portion 20 and a pair of leg portions 21. The bolt holes are arranged in a single row on each of upper and lower sides of the central portion 20 of the splicing plate, while two rows of bolt holes each on upper and lower sides are arranged on the side splicing plates 21 so as to cope with the allotted shear stresses.

The division of the splicing plate is not only rational in the allotment of the stress, but has an advantage of being able to flexibly cope with the unevenness between the gusset plate and the intermediate plate caused by the erection accuracy at the site. Further, since the weight per location can be reduced, this arrangement exhibits the advantage of allowing the operation to be performed sufficiently by the human strength of operators without using special heavy machinery or equipment.

Figure 5:
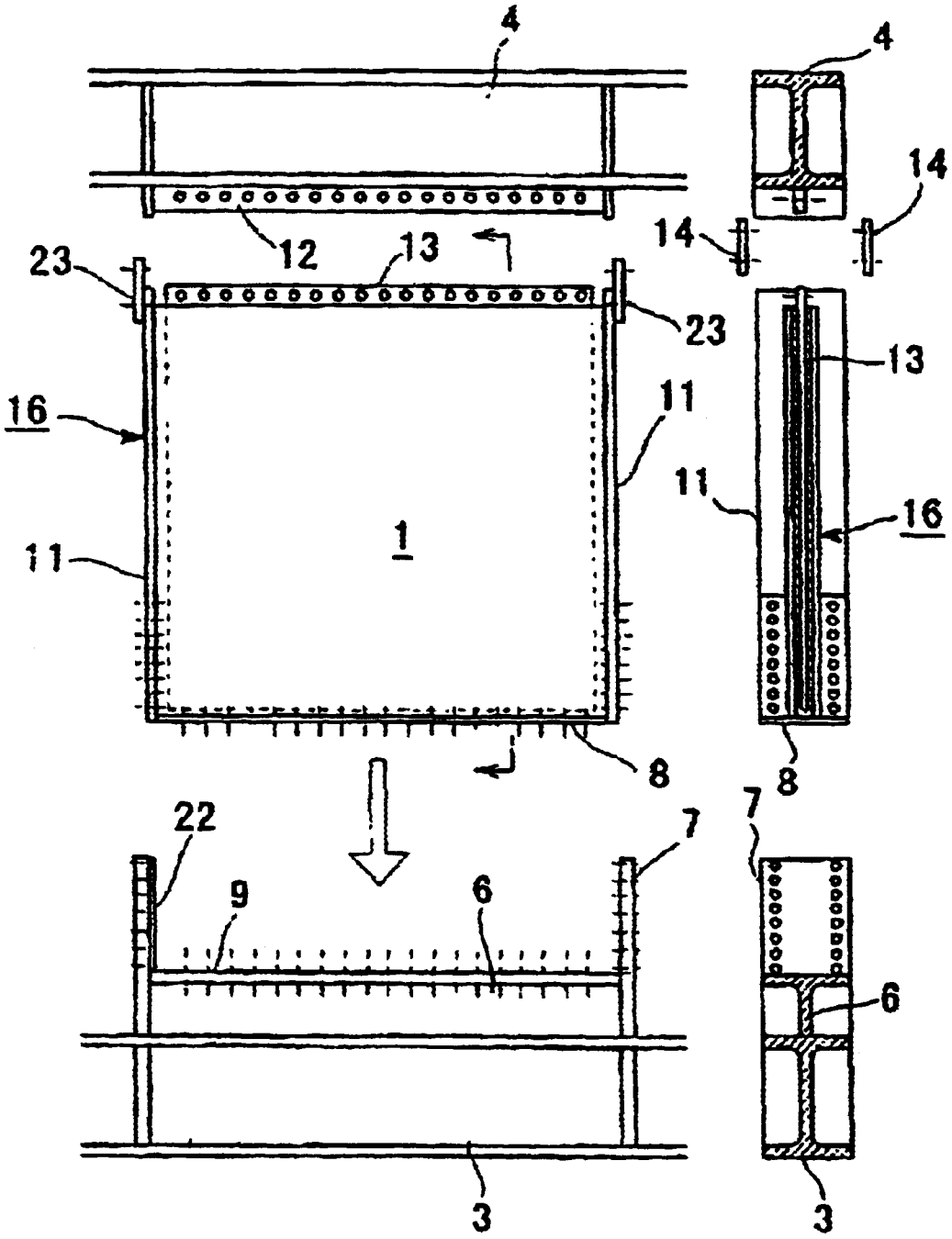
FIG. 5 is an exploded view of installation of the viscous vibration-damping wall in accordance with the invention.

FIG. 5 is an exploded view for explaining a method of installing a viscous vibration-damping wall in accordance with the invention.

The installing operation begins with the fixation to unillustrated pillars of the lower-floor girder 3 with the rising metal plate 6 integrated thereto by welding. At this juncture, a filler plate 22 for adjusting a gap is attached in advance to the flange connecting plate 7 at each end of the rising metal plate 6.

Meanwhile, the housing 16 of the viscous vibration-damping wall 1 is temporarily connected to the upper-floor girder 4 by means of a pair of temporarily connecting members 23. At the same time, the gusset plate 12 and the intermediate plate 13 are subjected to two-plane friction-type connection by the high-strength bolts by using the pair of splicing plates 14 so as to be directly connected to each other.

It should be noted that the direct connection based on the one-plane friction-type high-strength connection without using the splicing plates is the same as described before.

The upper-floor girder 4 integrated with the viscous vibration-damping wall 1 is suspended and set at a predetermined position, and the use of the temporarily connecting members 23 makes it possible to prevent the viscous material from undergoing shear deformation by the weight of the viscous vibration-damping wall, fix the viscous vibration-damping wall immovably, and suppress its rotation about the axis of the girder during hanging.

Hanging is effected to install the viscous vibration-damping wall 1 between the pair of flange connecting plates 7. At this juncture, adjustment of the gap and the like is made by inserting or removing the filler plate 22 attached in advance, so that the viscous vibration-damping wall will be accommodated between the flange connecting plates without strains.

Upon completion of positioning, one-plane friction-type high-strength bolted connection is effected between the base plate 8 and the base-plate connecting hole portions 9 and between the flange plate 11 and the flange connecting plate 7, thereby completing the installation of the viscous vibration-damping wall 1 on the main frame structure.

At this stage, the aforementioned temporarily connecting members 23 are removed, which makes it possible for the viscous vibration-damping wall 1 to assume a movable state whereby it is capable of demonstrating its intrinsic vibration-damping function, and the installation work is thereby completed.

Figure 6:
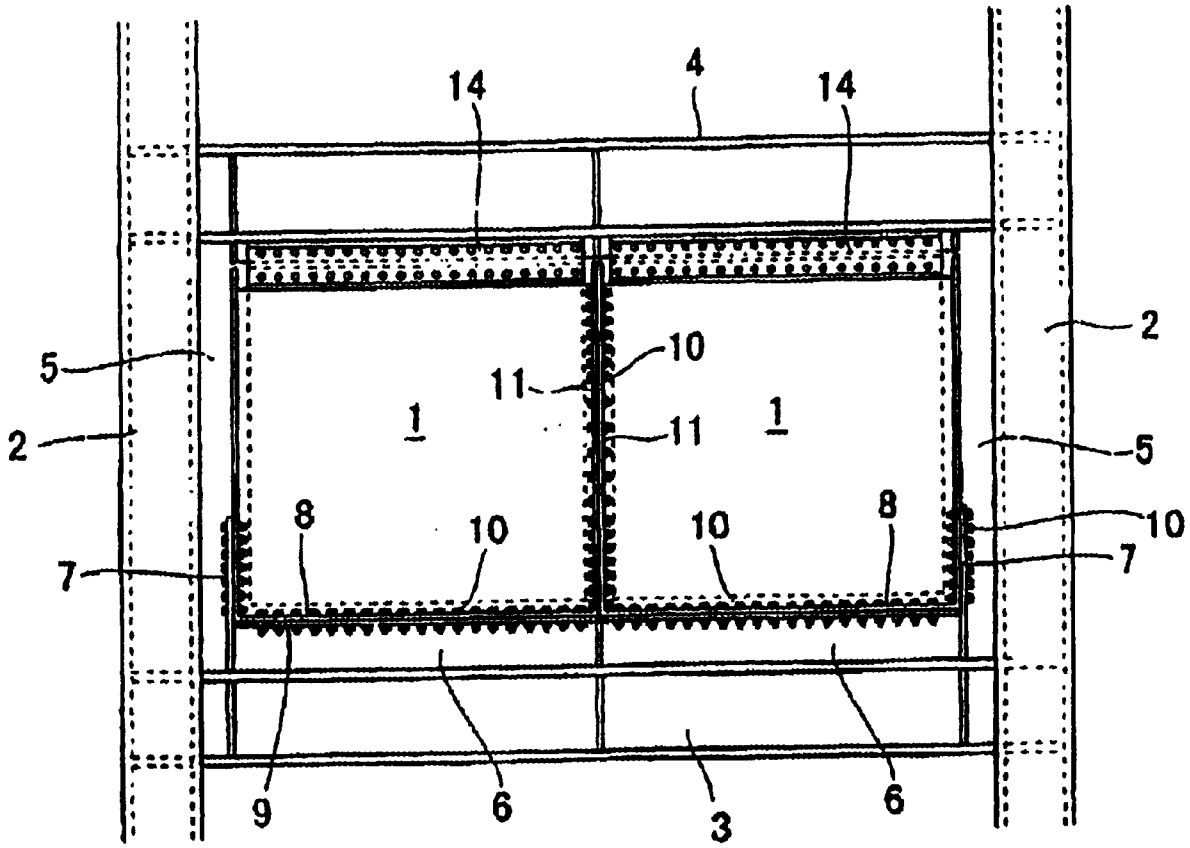
FIG. 6 is a diagram of a state of installation in which a plurality of viscous vibration-damping walls are installed in a juxtaposed manner on the main frame structure in accordance with the invention.
Figure 7:
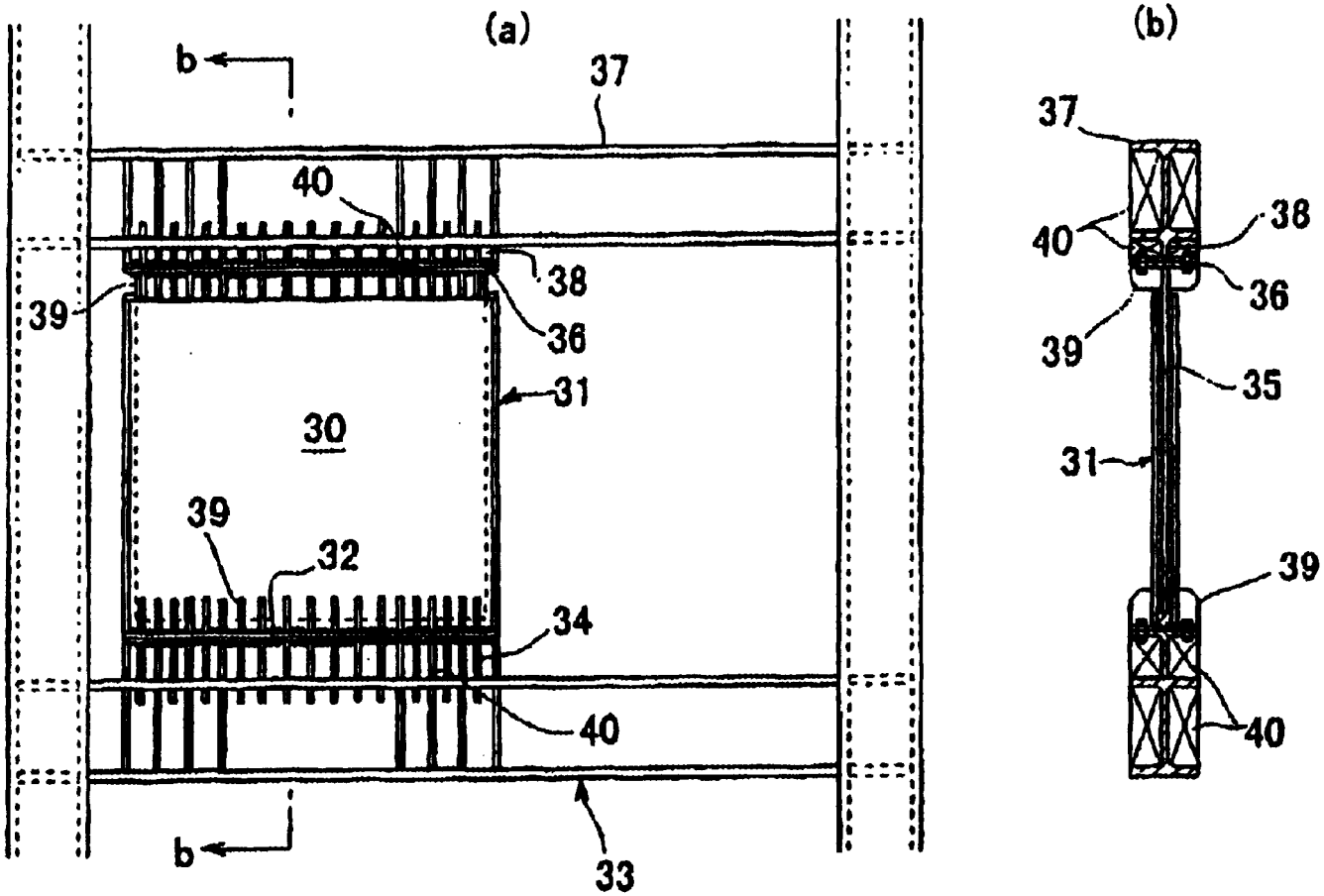
FIG. 7 (Prior Art)
FIG. 7 is a diagram of a state of the conventional installation of a viscous vibration-damping wall.
Figure 8:
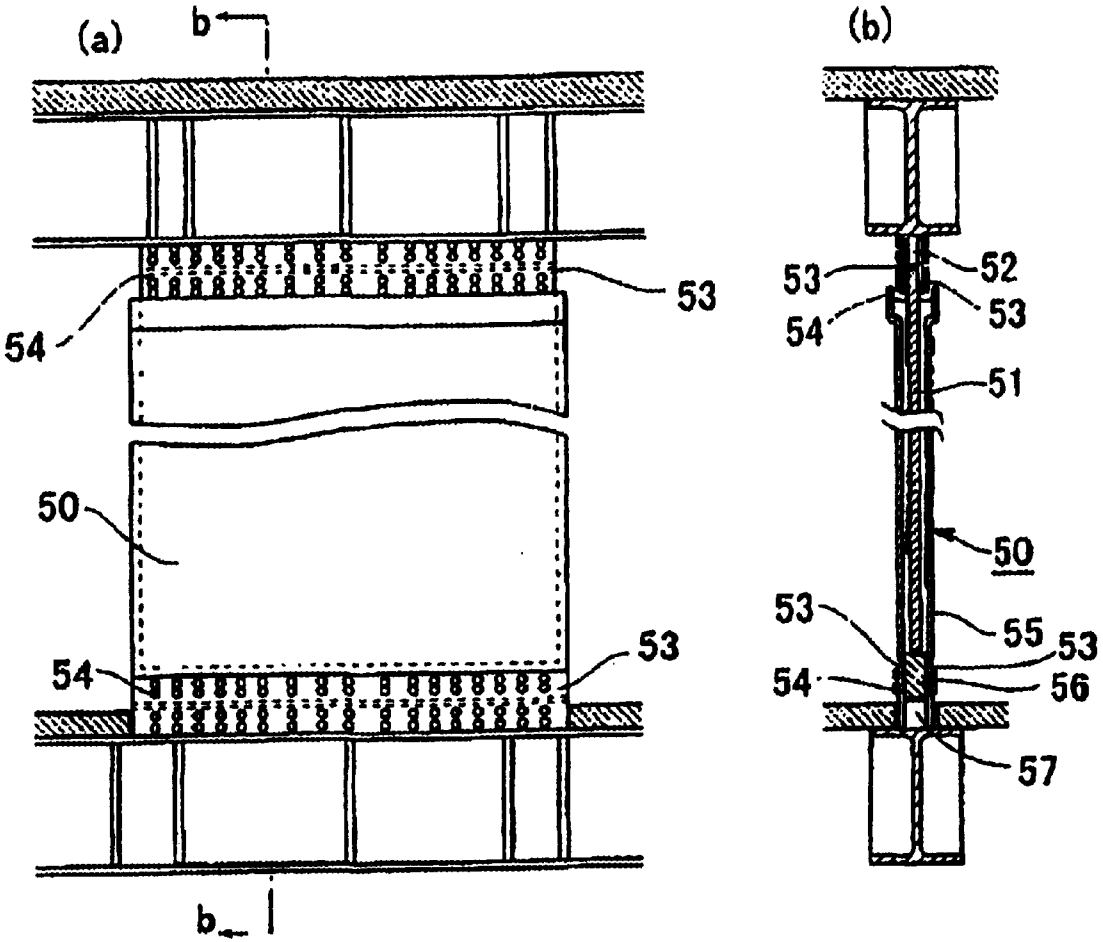
FIG. 8 (Prior Art)
FIG. 8 is a diagram of another state of the conventional installation of a viscous vibration-damping wall.

FIG. 6 is an elevational view of a state in which the viscous vibration-damping walls in accordance with the invention are installed in a juxtaposed manner.

A pair of viscous vibration-damping walls 1 are installed in a juxtaposed manner in the plane of structure 5 which is formed by the pair of pillars 2, the lower-floor girder 3, and the upper-floor girder 4, and is joined integrally to the lower-floor girder 3 and the upper-floor girder 4.

The rising metal plate 6 welded to the flange surface of the lower-floor girder 3 has a length allowing two viscous vibration-damping walls 1 to be placed thereon, and is integrated with the lower-floor girder 3, the pair of flange connecting plates 7 being respectively attached to both sides of the rising metal plate 6 in the same way as the embodiment shown in FIG. 1.

The viscous vibration-damping walls 1 at their mutually opposing flange plates 11 on their one sides are frictionally connected in one plane by the high-strength bolts 10, and this assembly in the integrated state is placed on the rising metal plate 6.

The viscous vibration-damping walls 1 are integrally connected to the lower-floor girder 3 as each base plate 8 and the base-plate connecting hole portions 9 of the rising metal plate 6 are frictionally connected in one plane by the high-strength bolts 10, and the flange plate 11 located on each side of the assembly of the viscous vibration-damping walls and each flange connecting plate 7 are frictionally connected in one plane by the high-strength bolts 10.

The flange connecting plates 7 process the lifting force of the base plates and the vertical force occurring in edge portions of the viscous vibration-damping walls by receiving as the shearing force of the high-strength bolts the bending moment due to the shearing force which is borne by the integrally connected viscous vibration-damping walls 1 during an earthquake.

Two gusset plates are attached to the lower flange surface of the upper-floor girder 4 in alignment with the web of the girder in the same way as the above-described embodiment.

The intermediate plate of each viscous vibration-damping wall 1 and the gusset plate are clamped by the two splicing plates 14, and are frictionally connected to each other in two planes by the high-strength bolts, thereby allowing the viscous vibration-damping walls 1 and the upper-floor girder 4 to be integrally connected.

As described above, the structure for installing a viscous vibration-damping wall in accordance with the invention is not limited to the installation of a single viscous vibration-damping wall, and is also applicable to the case where a plurality of viscous vibration-damping walls are installed in a juxtaposed manner. Regardless of the number of the viscous vibration-damping walls to be juxtaposed, by subjecting the flange plates on their mutually opposing sides to one-plate friction-type high-strength bolted connection, the entire unit can be handled as one viscous vibration-damping wall. In the fixation of the viscous vibration-damping walls to the upper-floor girder, the integration with the upper-floor girder can be ensured by merely temporarily attaching the temporarily connecting members to the outer flange plates.

What is claimed is:

1. A structure for installing a viscous vibration-damping wall between a lower-floor girder and an upper-floor girder, said viscous vibration-damping wall having a housing with an upper end open, an intermediate plate inserted in said housing through said open upper end, a viscous material or a viscoelastic material disposed in a gap portion between said housing and said intermediate plate, said housing having a base plate, a pair of steel side plates uprightly set on said base plate, and a pair of flange plates disposed on both lateral ends of said pair of side plates, respectively; said lower-floor girder having a first flange, and said upper-floor girder having a second flange, said structure comprising base-plate connecting hole portions provided on said first flange of said lower-floor girder, a pair of flange connecting plates provided on said first flange of said lower-floor girder, respectively, and a gusset plate attached to said second flange of said upper-floor girder, said intermediate plate being directly connected to said gusset plate, said base plate-connecting hole portions being connected to said base plate by high-strength bolts, and said pair of flange connecting plates being connected to said pair of flange plates by high-strength bolts.

2. The structure for installing a viscous vibration-damping wall according to claim 1, further comprising a rising metal plate fixed on the first flange of said lower-floor girder, said base-plate connecting hole portions and said pair of flange connecting plates being provided on said first flange of said lower floor girder through said rising metal plate.

3. The structure for installing a viscous vibration-damping wall according to claim 1, wherein said flange plate and said flange connecting plate are connected to each other by high-strength bolts, and a surface of said flange plate and a surface of said flange connecting plate being in frictional engagement with each other.

4. The structure for installing a viscous vibration-damping wall according to claim 1, further comprising a filler plate interposed for each of said flange connecting plates.

5. The structure for installing a viscous vibration-damping wall according to claim 1, wherein said intermediate plate and said gusset plate are connected to each other by high-strength bolts, and a surface of said intermediate plate and a surface of said gusset plate are frictionally contacted to each other.

6. The structure for installing a viscous vibration-damping wall according to claim 1, further comprising a pair of splicing plates, said intermediate plate and said gusset plate being connected to each other by high-strength bolts and said pair of splicing plates, both surfaces of said intermediate plate are frictionally contacted to corresponding surfaces of said pair of splicing plates, respectively, and both surfaces of said gusset plate being in frictional engagement with corresponding surfaces of said pair of splicing plates, respectively.

7. The structure for installing a viscous vibration-damping wall according to claim 6, wherein each of said splicing plates includes a central portion and a pair of side portions separated from said central portion.

8. A method of installing a viscous vibration-damping wall in a structure, said viscous vibration-damping wall having a housing with an open upper end, an intermediate plate inserted in said housing through said open upper end thereof, and a viscous material or a viscoelastic material disposed in a gap portion between said housing and said intermediate plate, said housing having a base plate, a pair of side plates on said base plate, and a pair of flange plates on both lateral ends of said pair of side plates, respectively, comprising the steps of:

setting a lower-floor girder having base plate connecting hole portions and flange-connecting plates at a predetermined position;

preparing an upper-floor girder having a flange and a gusset plate attached to said flange;

temporarily connecting said housing and said upper floor girder;

securing said intermediate plate to said gusset plate;

setting said upper-floor girder at a predetermined position elevated above said lower-floor girder;

securing said base plate and said base plate connecting hole portions to one another;

securing said flange plates and said flange-connecting plates to one another; and releasing said temporary connection of said housing and said upper-floor girder.

* * * * *

UNITED STATES PATENT AND TRADEMARK OFFICE

CERTIFICATE OF CORRECTION

PATENT NO. : 6,681,536 B1
DATED : January 27, 2004
INVENTOR(S) : Isoda

It is certified that error appears in the above-identified patent and that said Letters Patent is hereby corrected as shown below:

Title Page, Item [54] and Column 1, Lines 1-2,
Title, delete "MOUNTING STRUCTURE AND METHOD FOR VISCOSITY SYSTEM DAMPING WALL" and insert -- STRUCTURE FOR INSTALLING A VISCOUS VIBRATION-DAMPING WALL AND METHOD OF INSTALLING THE SAME --.

Signed and Sealed this

First Day of June, 2004

JON W. DUDAS
*Acting Director of the United States Patent and Trademark Office*